US011235967B1

(12) United States Patent
Hurlburt

(10) Patent No.: US 11,235,967 B1
(45) Date of Patent: Feb. 1, 2022

(54) HORSE TRAINING DEVICE

(71) Applicant: Casey D. Hurlburt, Ord, NE (US)

(72) Inventor: Casey D. Hurlburt, Ord, NE (US)

( * ) Notice: Subject to any disclaimer, the term of this patent is extended or adjusted under 35 U.S.C. 154(b) by 223 days.

(21) Appl. No.: 16/515,567

(22) Filed: Jul. 18, 2019

(51) Int. Cl.
*B68B 1/04* (2006.01)
*B68B 5/00* (2006.01)

(52) U.S. Cl.
CPC ..... *B68B 1/04* (2013.01); *B68B 5/00* (2013.01); *B68B 2001/042* (2013.01)

(58) Field of Classification Search
CPC ..... B68B 1/04; B68B 5/00; B68B 2001/042; B68B 1/00; B68B 1/02
See application file for complete search history.

(56) References Cited

U.S. PATENT DOCUMENTS 2,572,517 A * 10/1951 Ratliff ..... B68B 1/06 54/6.1
2,623,340 A * 12/1952 Rudolph ..... B68B 1/04 54/6.1
2,625,780 A * 1/1953 Flatt ..... B68B 1/06 54/6.1
2,752,746 A * 7/1956 Swartz ..... B68B 1/06 54/6.1
3,312,039 A 4/1967 Reed
3,458,971 A 8/1969 Stern et al.
3,731,456 A 5/1973 Hill
4,337,610 A 7/1982 Taylor
4,495,752 A 1/1985 Simpson
4,563,493 A 4/1986 Terry
4,583,493 A * 4/1986 Terry ..... B68B 1/00 54/71
4,589,248 A * 5/1986 Ruddock ..... B68B 1/04 54/24
5,001,892 A 3/1991 Mezin et al.
6,643,999 B1 * 11/2003 Wheat ..... B68B 1/04 54/6.1
8,429,884 B2 4/2013 Roberts
2008/0115468 A1 * 5/2008 Howard ..... B68B 1/04 54/6.1

* cited by examiner

*Primary Examiner* — Timothy D Collins
*Assistant Examiner* — Madeline L Douglas
(74) *Attorney, Agent, or Firm* — Dennis L. Thomte; Thomte Patent Law Office LLC

(57) ABSTRACT

A horse training device which is adjustable to fit various sizes of horse heads and neck sizes. The training device includes a generally U-shaped bosal-like member having a forward end and first and second legs extending rearwardly therefrom. A first ring is secured to the rearward ends of the first and second legs. A first U-shaped strap has its lower ends secured to second and third rings secured to the first and second legs respectively. A second strap has one end thereof secured to a cross-member which extends between the first and second legs. The other end of the second strap has a fourth ring member secured thereto. The lower ends of a U-shaped third strap are secured to the fourth ring. A U-shaped fourth strap is connected to the first and third straps and extend around the head of the horse below the ears of the horse.

3 Claims, 7 Drawing Sheets

HORSE TRAINING DEVICE

BACKGROUND OF THE INVENTION

Field of the Invention

This invention relates to a horse training device. More particularly, this invention relates to a bitless horse training device. Even more particularly, this invention relates to a horse training device which is adjustable to fit the heads and necks of different sizes of horses. Even more particularly, this invention relates to a horse training device which enables side pull to be exerted on the head of the horse.

Description of the Related Art

It has long been the practice when breaking or training a horse to place a halter or harness or bridle over the head of the horse to teach the horse to obey commands. The early training devices included a bit which was placed in the horse's mouth. The bitted bridles were not satisfactory since the horse would fight against the bit, thus causing injury to the horse's mouth. Therefore, there is a need for an improved horse training device that does not include a bit. Further, the prior devices for training horses are not believed to be stable and efficient. Further, it is believed that the prior art training devices are not readily adaptable to heads and necks of different sizes of horses. Further, applicant does not believe that any of the prior art horse training devices have means to exert side pull on the device.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A horse training device is disclosed which includes a bosal-like member including a generally U-shaped forward end portion having first and second leg members extending rearwardly, inwardly and downwardly from the generally U-shaped forward end portion with the first and second leg members having spaced-apart rearward ends. A first ring member is secured to the rearward ends of the first and second leg members and a cross-member is secured to the first and second leg members forwardly of the first ring member so as to extend between the first and second leg members. The device also includes a second ring member which is secured to the first leg member forwardly of the cross-member and a third ring member which is secured to the second leg member forwardly of the cross-member. The device also includes a flexible and inverted and generally U-shaped first strap which has a lower first end, a lower second end and an upper end. The lower first end of the first strap is secured to the second ring member and the lower second end of the first strap is secured to the third ring member. The first strap is configured to be placed on the upper neck of the horse behind the ears of the horse.

The device of this invention also includes an elongated and flexible second strap having a rearward end and a forward end with the second strap being positioned below the neck of the horse. The rearward end of the second strap is secured to the cross-member. A sixth ring member is secured to the forward end of the second strap. The device also includes a flexible inverted and generally U-shaped third strap having a lower first end, a lower second end and an upper end. The lower first end of the third strap and the lower second end of the third strap are secured to the sixth ring member. The third strap is configured to be positioned around the neck of the horse rearwardly of the first strap. The device also includes an elongated and flexible fourth strap having a first end and a second end with the fourth strap being configured to be positioned partially around the upper end of the head of the horse forwardly of the ears of the horse. The first end of the fourth strap is secured to the third strap and a second end of the fourth strap is secured to the third strap. The first and second ends of the fourth strap are also secured to the first strap.

An elongated and flexible first rein having a forward end and a rearward end is provided with the forward end of the first rein being selectively removably secured to the first ring member. An elongated and flexible second rein having a forward end and a rearward end is also provided with the forward end of the flexible second rein being selectively removably secured to the first ring member.

The device of this invention also includes a fourth ring member which is secured to the first leg member and which extends outwardly from the first leg member between the first ring member and the second ring member and wherein a fifth ring member is secured to the second leg member and which extends outwardly from the second leg member between the first ring member and the third ring member and wherein the forward ends of the first and second reins may be selectively removably secured to the fourth and fifth ring members respectively.

The first, second and third straps are length adjustable. The fourth strap is selectively vertically movable with respect to the first and third straps to fit different sizes of horses. The same is also true of the length adjustable first and third straps as well as the fourth strap.

The horse training device of this invention is adjustable to fit different sizes of horses and is bitless. Further, the device of this invention includes fourth and fifth ring members which enable the reins to be selectively secured thereto to provide a side pull of the head of the horse.

It is therefore a principal object of the invention to provide an improved horse training device.

A further object of the invention is to provide a horse training device which may be adjusted to fit different sizes of horse heads.

A further object of the invention is to provide a device of the type described which enables the reins thereof may be attached to either the first ring member as described or to the fourth and fifth ring members.

A further object of the invention is to provide a horse training device which is easily secured to the horse and is easily removed therefrom.

A further object of the invention is to provide a horse training device which is comfortable to the horse.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
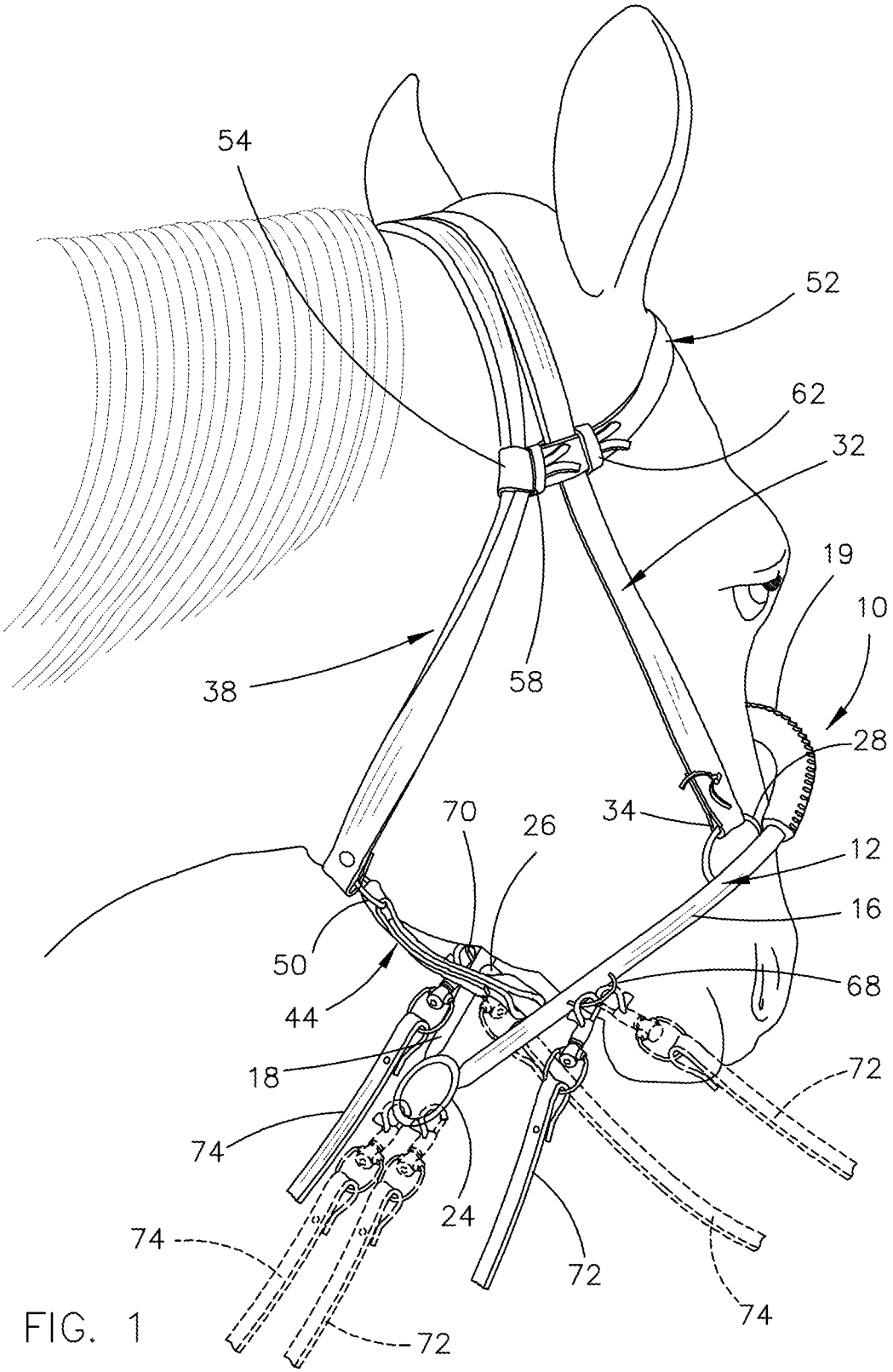
FIG. 1 is a partial rear perspective view illustrating the device of this invention mounted on a horse with the dashed lines illustrating the manners in which the reins of the invention may be attached to the device.
Figure 2:
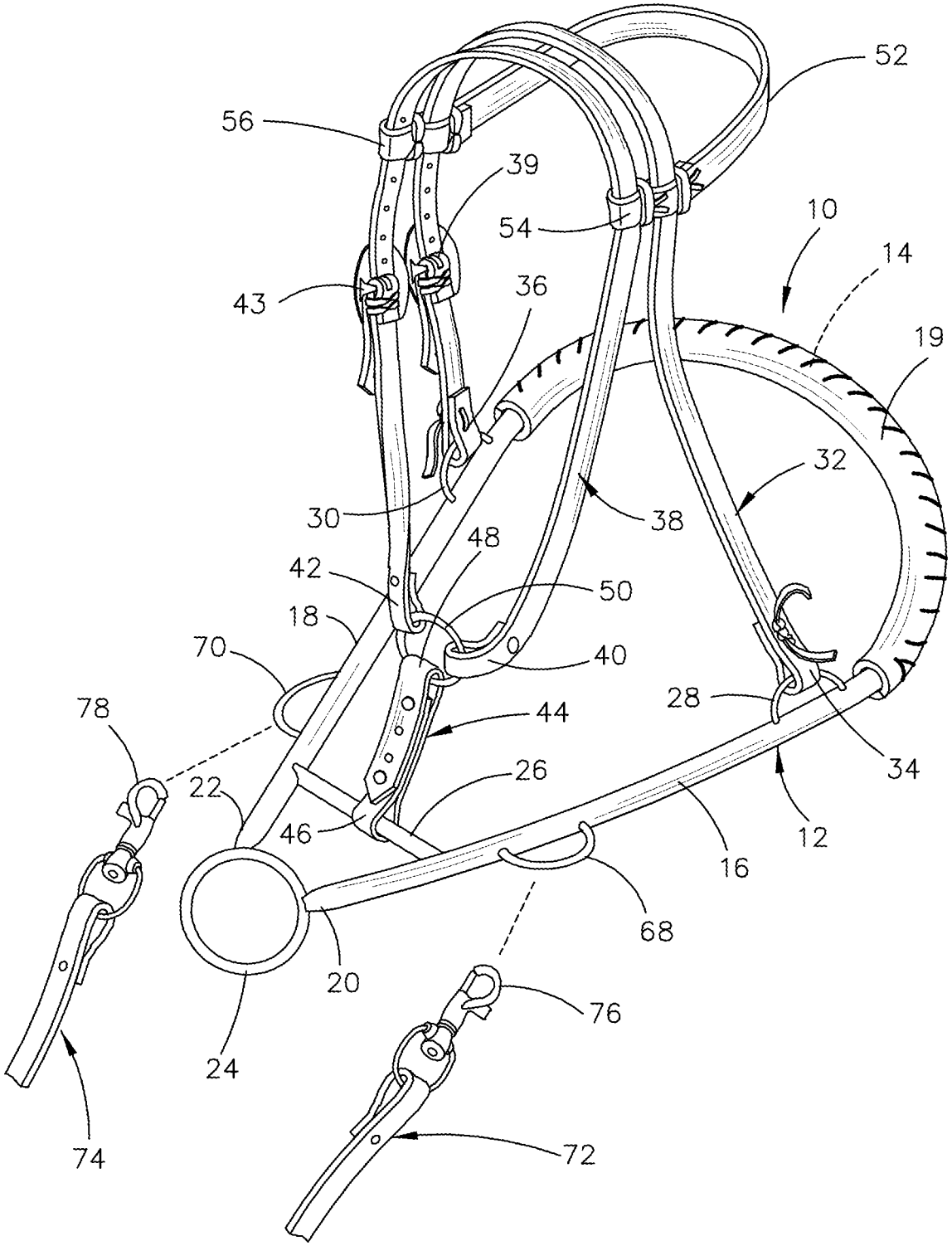
FIG. 2 is a rear perspective view of the device of this invention.
Figure 3:
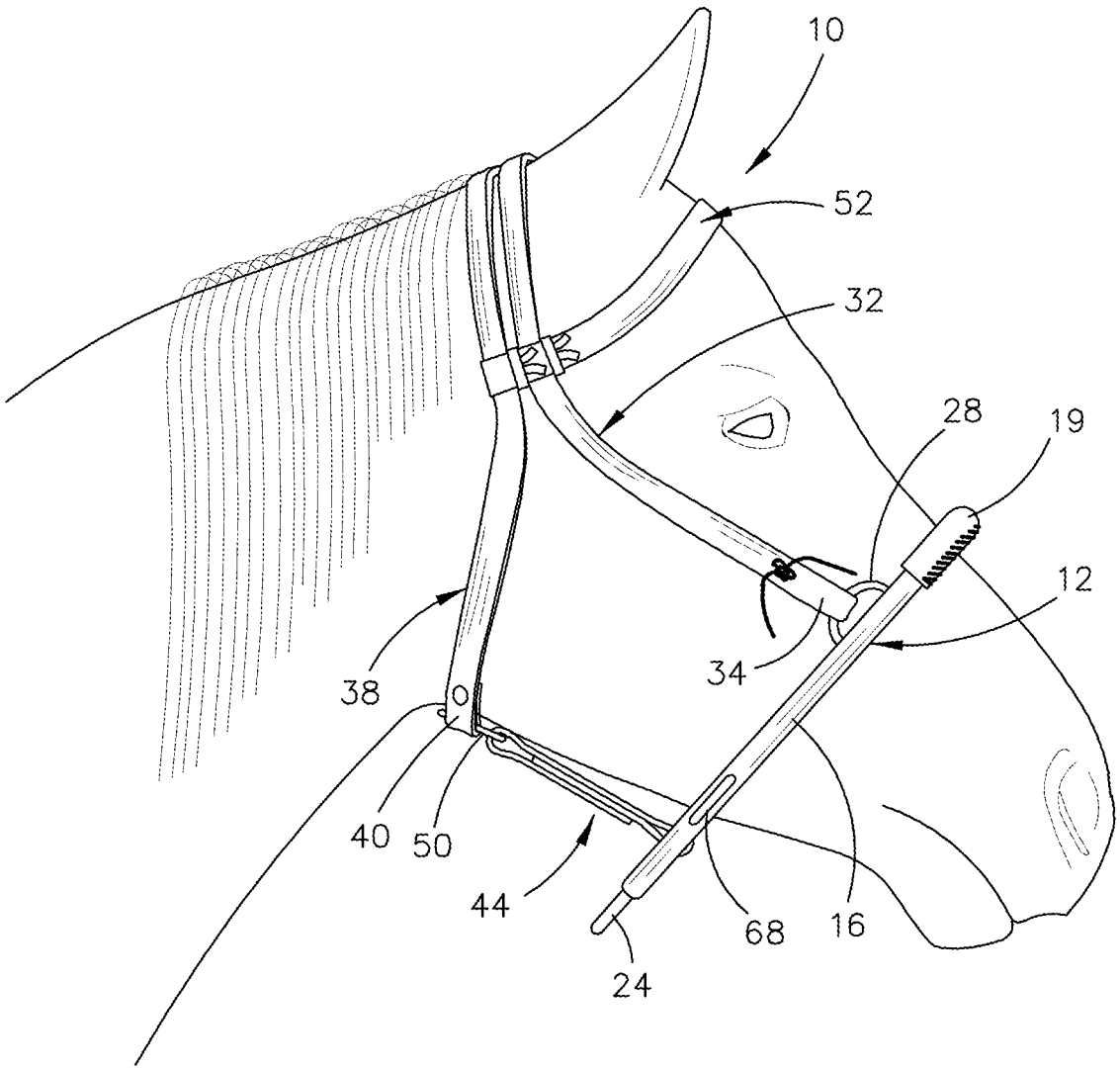
FIG. 3 is a side view illustrating the device of this invention mounted on a horse.
Figure 4:
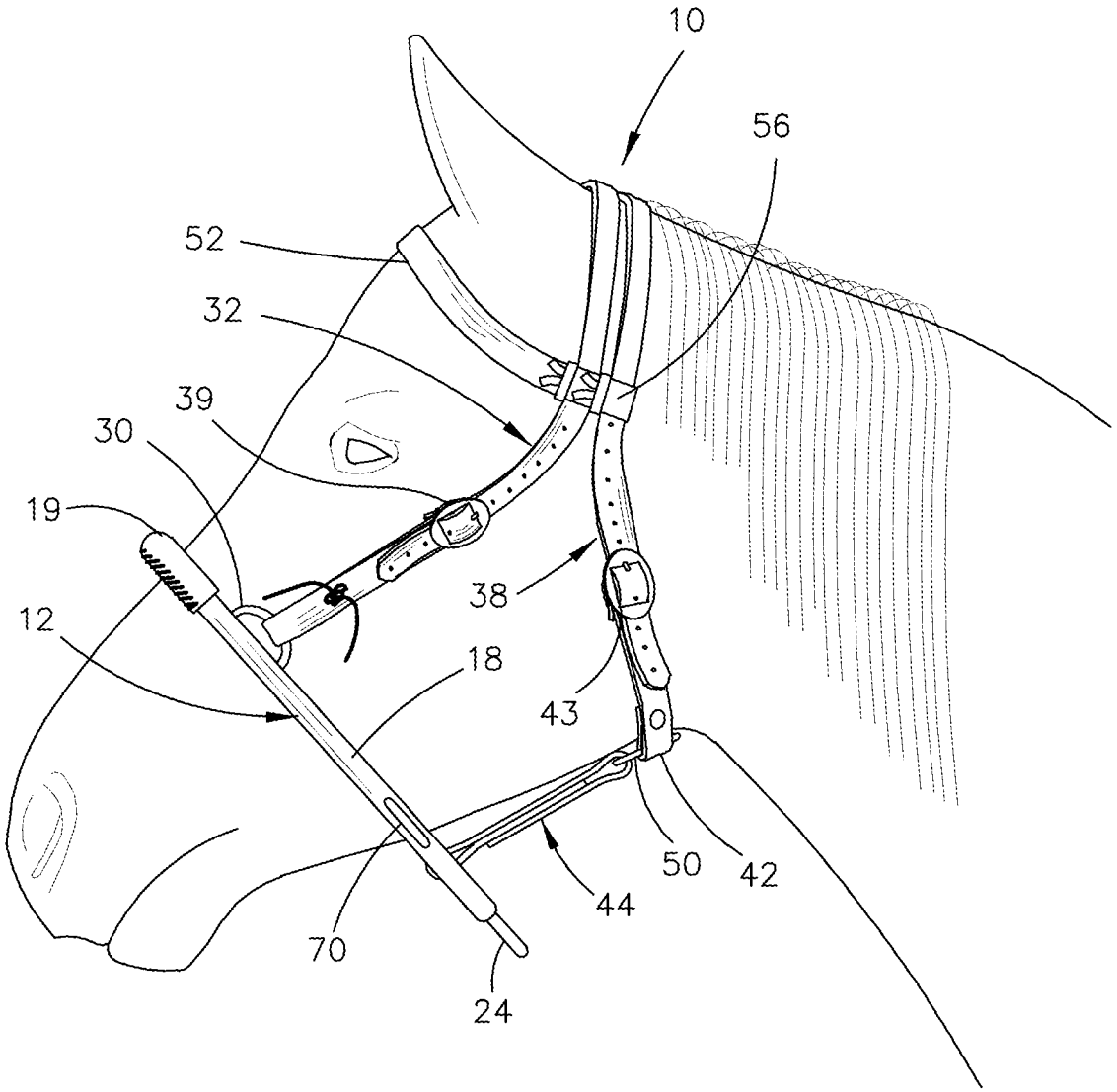
FIG. 4 is a side view, opposite to the side view of FIG. 3, illustrating the device of this invention mounted on a horse.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The horse training device of this invention is designated by the reference numeral 10. Device 10 includes a bosal-like member (hereinafter "bosal") 12, sometimes called a nose strap, nose piece or nose band, which is disposed over the snout of the animal. Bosal 12 will be described as being generally U-shaped which includes a curved forward end portion 14 having leg portions 16 and 18 extending rearwardly, downwardly and inwardly from forward end portion 14. The curved forward end portion 14 is covered with a leather padding material 19. The rearward ends 20 and 22 of leg portions 16 and 18 respectively are attached to a metal ring 24 by welding. A metal cross-member 26 is secured to leg portions 16 and 18 by welding so as to extend therebetween forwardly of ring 24.

Leg portion 16 has a ring 28 secured thereto at its upper end by welding forwardly of cross-member 26. Leg portion 18 has a ring 30 secured thereto by welding forwardly of cross-member 26. The numeral 32 refers to an elongated and generally U-shaped and flexible strap 32 having opposite looped ends 34 and 36. Strap 32 is length adjustable by a conventional buckle 39 and has looped end 34 thereof secured to ring 28 and has looped end 36 thereof secured to ring 30. The numeral 38 refers to a generally U-shaped flexible strap having looped ends 40 and 42. Strap 38 is length adjustable by a conventional buckle 43.

The numeral 44 refers to a short flexible strap having a lower end loop 46 and an upper end loop 48 formed thereon. The lower end loop 46 of strap 44 is secured to cross-member 26. The upper end loop 48 of strap 44 is secured to ring member 50. Strap 44 is length adjustable. The ends 40 and 42 of strap 38 are secured to ring member 50.

The numeral 52 refers to a flexible strap having looped ends 54 and 56. Strap 52 has its looped end 54 positioned at the right side of the head of the horse and has its looped end 56 positioned at the left side of the head of the horse. The portion of strap 38 which is positioned at the right side of the head of the horse slidably extends through the looped end 54 of strap 52 at the rearward end thereof. The portion of strap 38 which is positioned at the left side of the head of the horse slidably extends through the looped end 56 of strap 52 at the rearward end thereof. A portion of strap 32 at the right side of the head of the horse slidably extends through looped end 54 of strap 52 at the forward end of looped end 54. A portion of strap 32 at the left side of the head of the horse slidably extends through looped end 56 of strap 52 at the forward end of the looped end 56. A short strap 58 is wrapped around the looped end 54 to separate straps 32 and 38 therein. A short strap 60 is wrapped around the looped end 56 to separate straps 32 and 38 therein.

Figure 5:
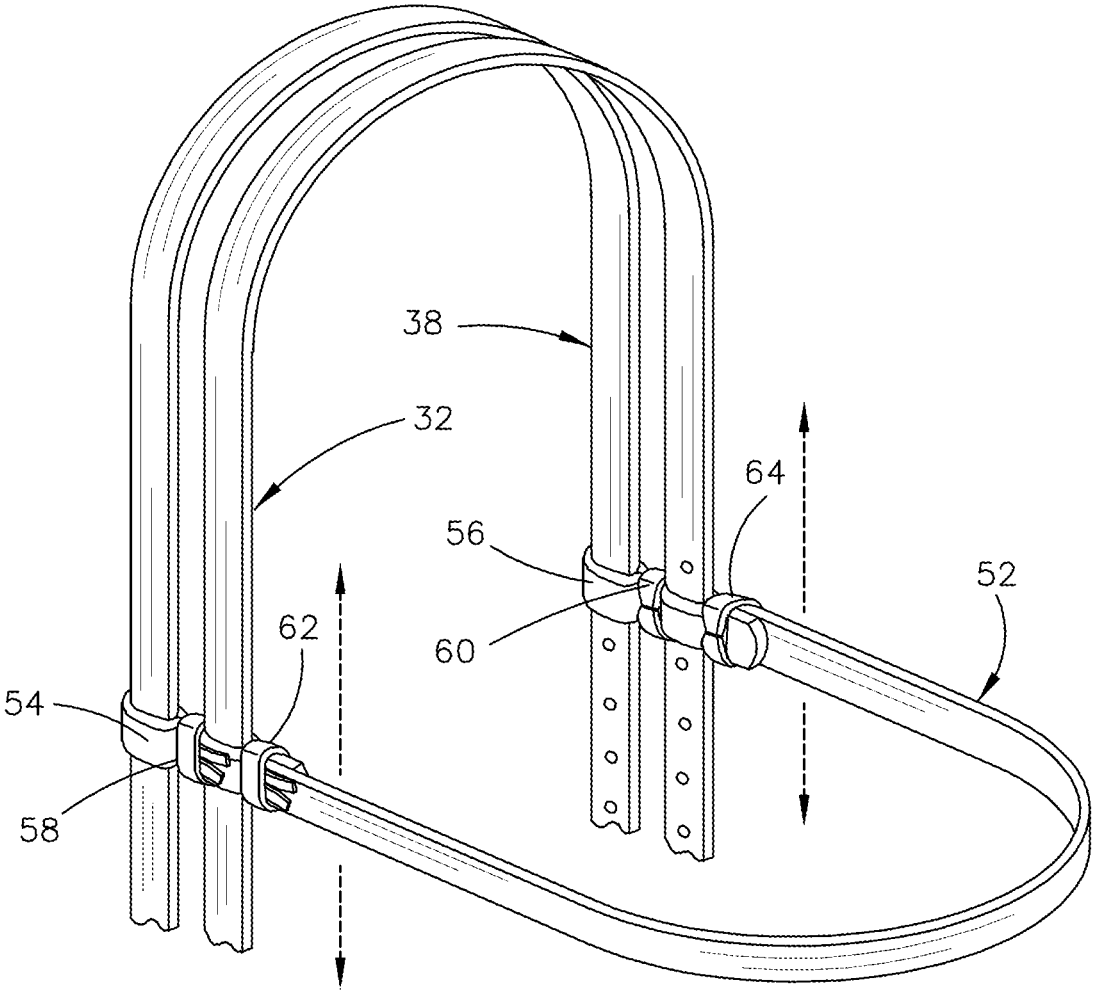
FIG. 5 is a partial perspective view illustrating the manner in which the fourth strap of this invention is selectively vertically movable with respect to the first and third straps respectively.
Figure 6:
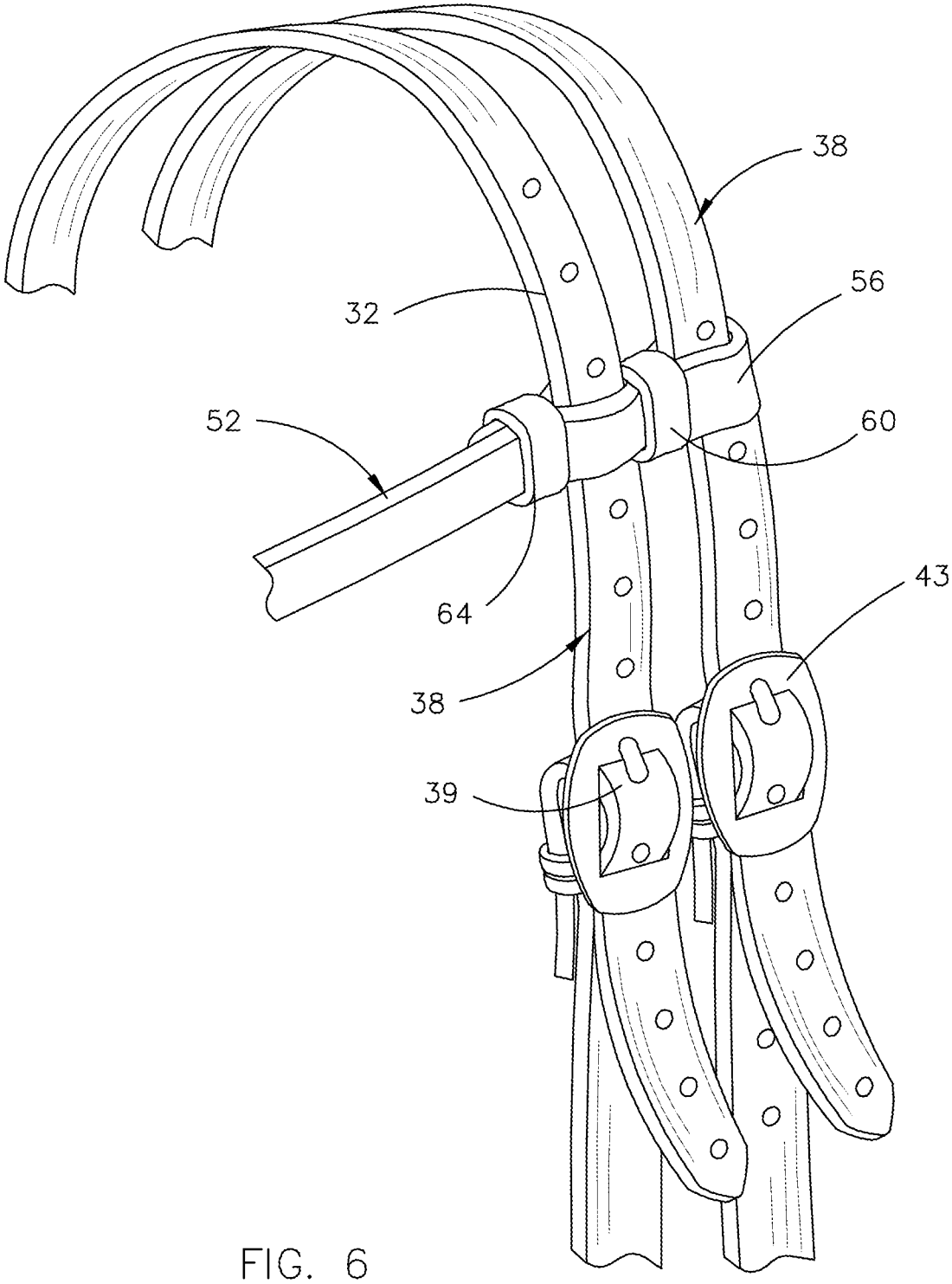
FIG. 6 is a partial front perspective view illustrating the manner in which the fourth strap is secured to the first and third straps.
Figure 7:
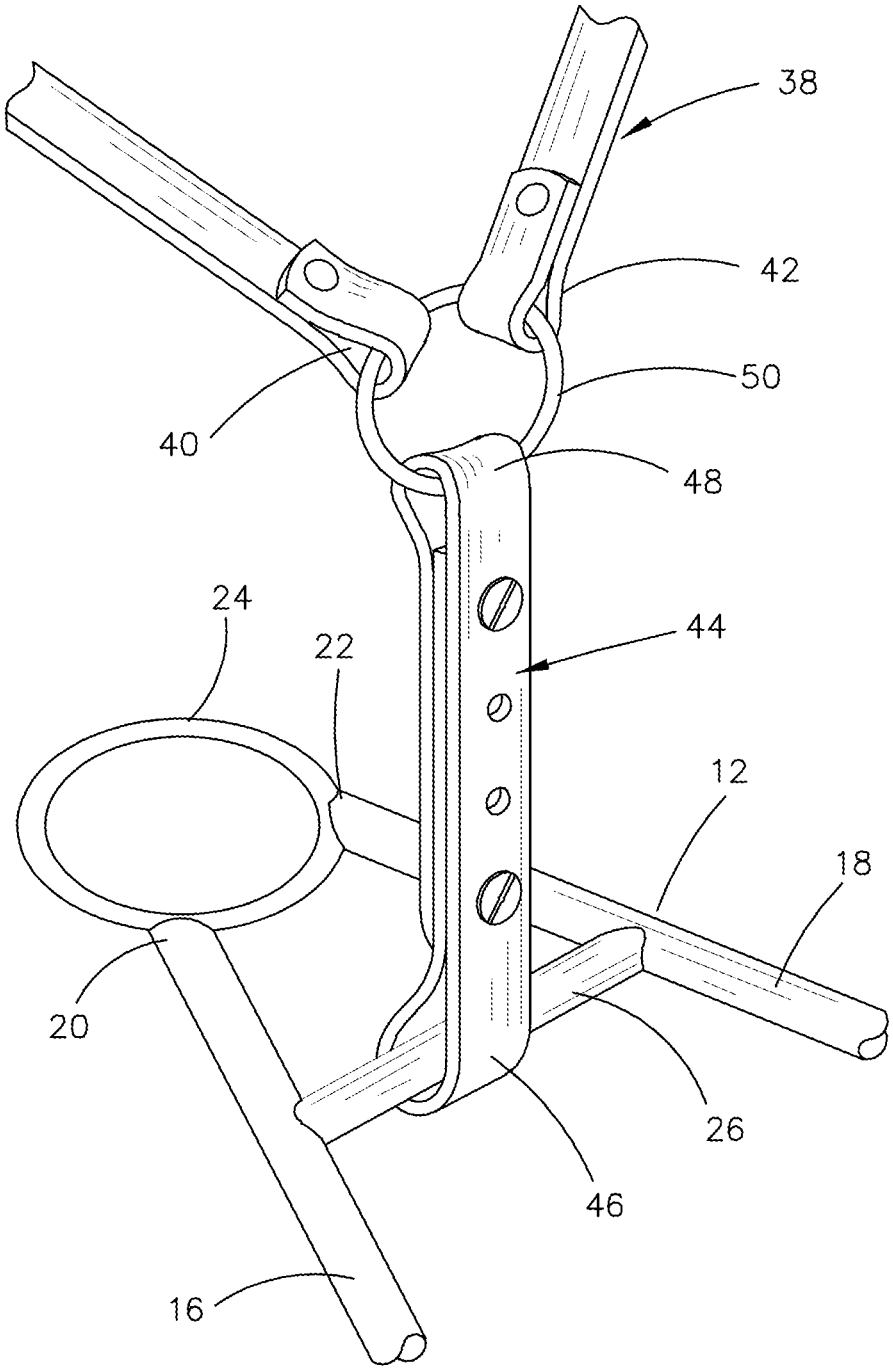
FIG. 7 is a partial perspective view illustrating the manner in which the ends of the third strap are secured to the cross-member of the bosal-like member.

As seen in FIG. 5, a short strap 62 is wrapped around the forward end of the looped end 54 forwardly of strap 32. A short strap 64 is wrapped around the forward end of the looped end 56 forwardly of strap 32. The short straps 58, 60, 62 and 64 permit strap 52 to be upwardly and downwardly adjustably moved with respect to straps 32 and 38 to compensate for different head sizes of the horses to be trained.

The device 10 also includes a semi-circular ring 68 which is secured to leg portion 16 of bosal 12 which extends laterally outwardly therefrom. Device 10 also includes a semi-circular ring member 70 which is secured to leg portion 18 of bosal 12 which extends laterally outwardly therefrom.

Device 10 also includes elongated reins 72 and 74 which have snaps 76 and 78 at one end thereof respectively. Reins 72 and 74 may be snapped onto ring 24 as indicated by broken lines in FIG. 1 so that the trainer or rider may control the movement of the horse. Reins 72 and 74 may also be snapped onto rings 68 and 70 so as to be able to exert "side pull" to the head of the horse. The reins or lead ropes 72 and 74 may also be snapped onto the ring 24 or the rings 68 and 70 to lead the horse.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. A horse training device, comprising:

a bosal-like member including a generally U-shaped forward end portion having first and second leg members extending rearwardly, inwardly and downwardly from said generally U-shaped forward end portion with said first and second leg members having spaced-apart rearward ends;

a first ring member secured to said rearward ends of said first and second leg members;

a cross-member secured to said first and second leg members forwardly of said first ring member so as to extend between said first and second leg members;

an upstanding second ring member secured to said first leg member forwardly of said cross-member;

an upstanding third ring member secured to said second leg member forwardly of said cross-member;

a fourth ring member secured to said first leg member which extends outwardly from said first leg member between said first ring member and said upstanding second ring member;

a fifth ring member secured to said second leg member which extends outwardly from said second leg member between said first ring member and said upstanding third ring member;

a flexible inverted and generally U-shaped and length adjustable first strap having a lower first end, a lower second end and an upper end;

said lower first end of said first strap being secured to said upstanding second ring member;

said lower second end of said first strap being secured to said upstanding third ring member;

said first strap being configured to be placed on the upper neck of the horse behind the ears of the horse;

an elongated and flexible second strap having a rearward end and a forward end;

said second strap being length adjustable;

said second strap being positioned below the neck of the horse;

said forward end of said second strap having a loop thereon;

said rearward end of said second strap having a loop thereon;

said loop at said rearward end of said second strap being secured to said cross-member;

a sixth ring member secured to said loop at said forward end of said second strap;

a flexible inverted and generally U-shaped and length adjustable third strap having a lower first looped end, a lower second looped end and an upper end;

said lower first looped end and said lower second looped end of said third strap being secured to said sixth ring member;

said third strap being configured to be positioned around the neck of the horse rearwardly of said first strap;

an elongated and flexible fourth strap having a first end loop portion and a second end loop portion with each of said first end loop portion and said second end loop portion of said fourth strap having a forward end and a rearward end;

said fourth strap being configured to be positioned partially around the upper end of the head of the horse forwardly of the ears of the horse;

said rearward end of said first end loop portion of said fourth strap extending around and being vertically adjustably secured to said third strap below said upper end of said third strap;

said rearward end of said second end loop portion of said fourth strap extending around and being vertically adjustably secured to said third strap below said upper end of said third strap;

said forward end of said first end loop portion of said fourth strap extending around and being vertically adjustably secured to said first strap below said upper end of said first strap;

said forward end of said second end loop portion of said fourth strap extending around and being vertically adjustably secured to said first strap below said upper end of said first strap;

an elongated and flexible first rein having a first end and a second end;

said first end of said flexible first rein being selectively removably secured to either of said first ring member or said fourth ring member;

an elongated and flexible second rein having a first end and a second end;

said first end of said flexible second rein being selectively removably secured to either of said first ring member or said fifth ring member;

said first rein, when said first end of said first rein is secured to said fourth ring member, enables said first rein to exert outward side null to the head of the horse;

said second rein, when said first end of said second rein is secured to said fifth ring member, enables said second rein to exert outward side pull to the head of the horse;

said first and second reins, when said first ends of said first and second reins are secured to said first ring member, enables said first and second reins to be used to lead the horse; and said first and second reins, when said first ends of said first and second reins are secured to said first ring member, enables the movement of the horse to be controlled.

2. The horse training device of claim 1 wherein said first end of said fourth strap has a loop portion and wherein said second end of said fourth strap has a loop thereon and wherein said loop portion on said first end of said fourth strap embraces said first and third straps and wherein said loop portion on said second end of said fourth strap embraces said first and third straps.

3. The horse training device of claim 2 wherein each of said loop portions of said fourth strap frictionally embrace said first and third straps.

* * * * *